US005273020A

United States Patent [19]

Hayami

[11] Patent Number: 5,273,020

[45] Date of Patent: Dec. 28, 1993

[54] FUEL VAPOR PURGING CONTROL SYSTEM FOR AUTOMOTIVE VEHICLE

[75] Inventor: Toshifumi Hayami, Kariya, Japan

[73] Assignee: Nippondenso Co., Ltd., Kariya, Japan

[21] Appl. No.: 53,484

[22] Filed: Apr. 29, 1993

[30] Foreign Application Priority Data

Apr. 30, 1992 [JP] Japan ..... 4-111462
May 13, 1992 [JP] Japan ..... 4-120793

[51] Int. Cl.[5] ..... F02M 39/00
[52] U.S. Cl. ..... 123/520; 123/516
[58] Field of Search ..... 123/198 D, 520, 519, 123/518, 516, 521

[56] References Cited

U.S. PATENT DOCUMENTS

| | | | |
|---|---|---|---|
| 3,680,318 | 8/1972 | Nakajima | 123/519 |
| 4,070,828 | 11/1978 | Barres | 123/521 |
| 4,664,087 | 5/1987 | Hamburg | 123/520 |
| 4,829,968 | 5/1989 | Onufer | 123/518 |
| 5,054,454 | 10/1991 | Hamburg | 123/520 |
| 5,080,078 | 1/1992 | Hamburg | 123/519 |
| 5,146,902 | 9/1992 | Cook | 123/518 |

FOREIGN PATENT DOCUMENTS

| | | | |
|---|---|---|---|
| 0021524 | 2/1977 | Japan | 123/519 |
| 0164763 | 12/1980 | Japan | 123/518 |
| 59-563 | 1/1984 | Japan . | |
| 59-192858 | 11/1984 | Japan . | |
| 61-17466 | 1/1986 | Japan . | |
| 62-6471 | 1/1987 | Japan . | |

*Primary Examiner*—Carl S. Miller
*Attorney, Agent, or Firm*—Cushman, Darby & Cushman

[57] ABSTRACT

A fuel vapor purging control system is provided. This system includes a fuel vapor collection canister, a purge control valve for controlling a purge flow rate of fuel vapors purged from the canister, a purge air induction passage communicating between the canister and an air inlet port which is exposed to atmospheric pressure, an air pump for supplying pressurized air to the canister through the purge air induction passage, a pressure sensor for detecting negative pressure in an induction system of the engine, and a purge air control unit. When the engine falls to a relatively high load level and the negative pressure becomes smaller than a preselected threshold value, the purge air control unit directs the pressurized air from the air pump to the canister for assuring a desired purge flow rate during each engine operation.

12 Claims, 14 Drawing Sheets

FUEL VAPOR PURGING CONTROL SYSTEM FOR AUTOMOTIVE VEHICLE

BACKGROUND OF THE INVENTION

1. Field of the Invention

The present invention relates generally to an evaporation control system for an internal combustion engine and particularly to a fuel vapor purging control system which is capable of controlling a purge rate of fuel vapors from a fuel vapor storage canister over a wide range of engine operation.

2. Description of the Prior Art

Japanese Patent First Publication No. 59-192858 discloses a canister purge control system for an automotive vehicle. This system includes a variable displacement pump arranged between a canister and an induction passage of the engine. The variable displacement pump is controlled according to engine operating conditions over a range of low to high engine loads to draw a purging stream of air through the canister so as to purge collected fuel vapors from the canister. Therefore, even when the engine is operating under high load conditions, a desired purge flow rate may be assured.

The above prior art canister purge control system, however, encounters a drawback in that the variable displacement pump is always driven by the engine even during low engine load operation where the engine manifold vacuum level is sufficient for drawing ambient air into the canister for purging fuel vapors collected therein, thus resulting in engine load being increased undesirably.

Additionally, Japanese Utility Model First Publication No. 61-17466 discloses a canister purge control system which includes two purge lines each communicating between a canister and an induction passage of the engine. A purge control valve is arranged in one of the purge lines, which is energized to modify a purge flow rate through the canister when engine load is relatively low. An air pump is disposed in the other of the purge lines, which serves to draw air and fuel vapors collected in the canister into the engine for engine starting control. With this arrangement, when the engine load becomes high, the air pump may also be utilized to purge fuel vapors from the canister. However, assuring a desired purge flow rate at high engine loads requires finely controlling the air pump.

SUMMARY OF THE INVENTION

It is therefore a principal object of the present invention to avoid the disadvantages of the prior art.

It is another object of the invention to provide a fuel vapor purging control system for an automotive vehicle which is operable to establish a pressure difference between upstream and downstream lines of a fuel vapor collection canister sufficient for controlling a purge flow rate precisely even during high load engine operation where an engine induction passage vacuum level is relatively low.

According to one aspect of the present invention, there is provided a fuel vapor purging control system for an automotive vehicle which comprises a canister adapted for capturing therein fuel vapor generated from a fuel tank, the canister being arranged in a purge passage communicating between the fuel tank and an induction system of an engine, a purge control valve operable to control a purge rate of the fuel vapor purged from the canister, the purge control valve being arranged in a portion of the purge passage between the canister and the induction system of the engine, a purge air induction passage communicating between the canister and an air inlet port which is exposed to atmospheric pressure, an air source means for supplying pressurized air to the canister through the purge air induction passage, a pressure detecting means for detecting negative pressure relative to the atmospheric pressure in the induction system of the engine to provide a signal indicative thereof, and a purge air control means for selectively establishing first and second purge air supply modes, the first purge air supply mode being to allow air under the atmospheric pressure to be introduced into the canister through the air inlet port, the second purge air supply mode being to supply the pressurized air from the air source means to the canister, the purge air control means being responsive to the signal from the pressure detecting means to establish the second purge air supply mode when the negative pressure is smaller than a preselected threshold value.

In the preferred modes, the purge air control means may include a directional control valve and a control unit. The directional control valve is operable to selectively assume first and second valve positions, the first valve position being to establish fluid communication between the air inlet port and the canister, the second valve position being to establish fluid communication between the air source means and the canister. The control unit is responsive to the signal from the pressure detecting means to provide a first control signal to the directional control valve to assume the first valve position for establishing the first purge air supply mode when the negative pressure is smaller than the preselected threshold value and a second control signal to the directional control valve to assume the second valve position for establishing the second purge air supply mode when the negative pressure is greater than the preselected threshold value.

According to another aspect of the present invention, there is provided a fuel vapor purging control system for an automotive vehicle which comprises a canister adapted for collecting therein fuel vapor subsequently generated from a fuel tank, the canister being arranged in a purge passage communicating between the fuel tank and an induction system of an engine, a purge control valve operable to control a purge rate of the fuel vapor purged from the canister, the purge control valve being arranged in a portion of the purge passage between the canister and the induction system of the engine, an air source means for providing pressurized air to the canister, a pressure regulating means disposed between the air source means and the canister, the pressure regulating means for maintaining a difference in pressure between upstream and downstream lines of the canister at a preselected constant level required for purging the fuel vapor from the canister, and a purge control means for controlling the purge control valve to modify a purge rate through the canister according to an operational condition of the engine.

In the preferred mode, the pressure regulating means may be exposed to atmospheric pressure when a pressure level in the induction system of the engine is lower than a preselected value. The purge control means deactivates the air source means when a pressure level in the induction system of the engine is lower than a preselected value.

BRIEF DESCRIPTION OF THE DRAWINGS

The present invention will be understood from the detailed description given hereinbelow and from the accompanying drawings of the preferred embodiments which are given for explanation and understanding only and are not intended to imply limitations to the invention.

In the drawings:

FIG. 2(*a*) shows the operation of a three-way valve 43 when being turned on.

FIG. 2(*b*) shows the operation of a threw-way valve 43 when being turned off.

DESCRIPTION OF THE PREFERRED EMBODIMENT

Figure 1:
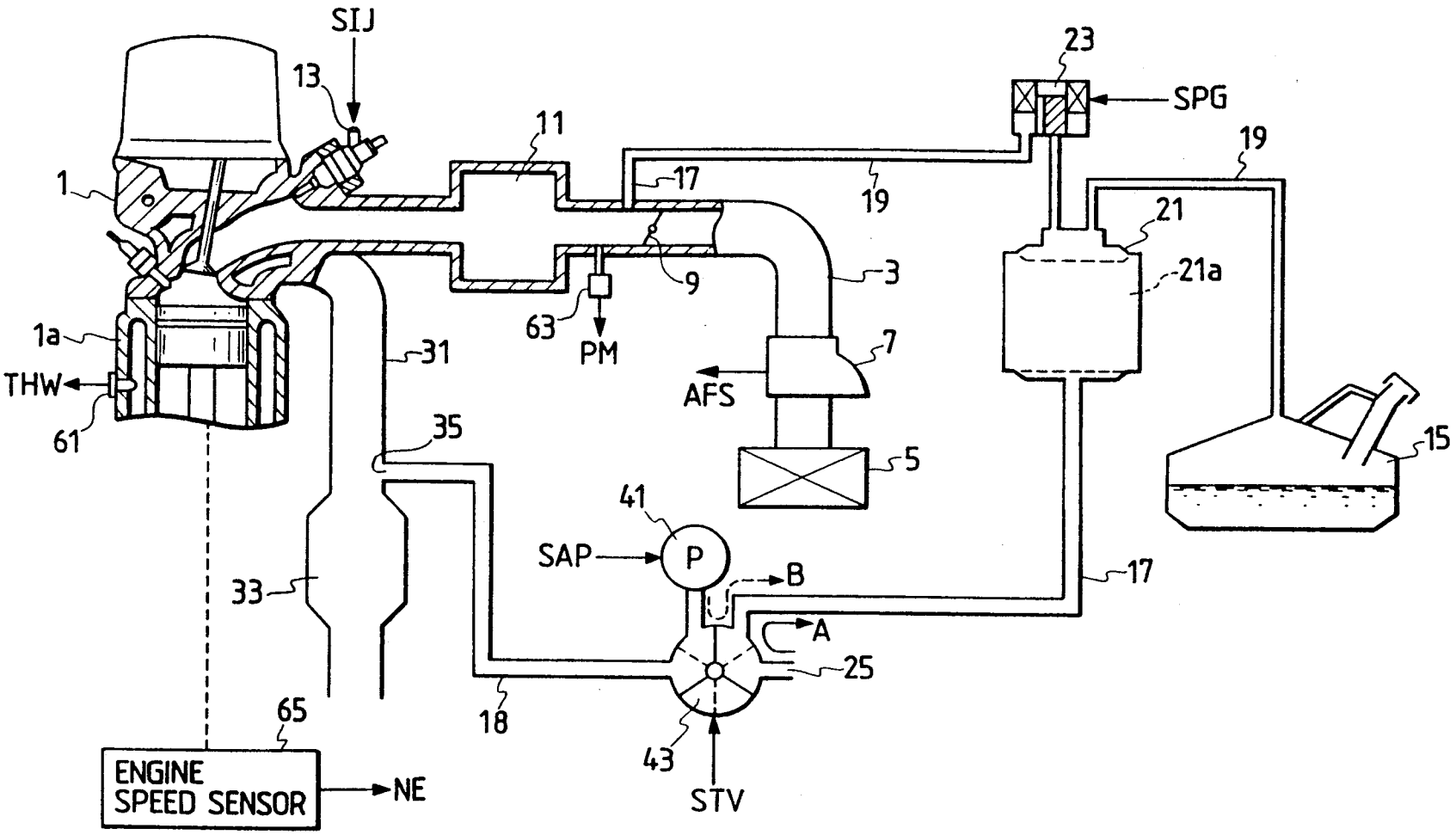
FIG. 1 is an illustration which shows a fuel vapor purging control system according to the present invention.

Referring now to the drawings, wherein like numbers refer to like parts in several views, particularly to FIG. 1, there is shown a fuel vapor purging control system according to the present invention.

An air cleaner 5, an airflow meter 7, a throttle valve 9, a surge tank 11, and a fuel injector 13 are connected to an intake passage 3 of an internal combustion engine 1. A purge port 17 is formed to open into a portion of the intake passage 3 immediately downstream from the throttle valve 9, which serves to direct fuel gas evaporated in a fuel tank 15 to the engine 1. A fuel vapor collection canister 21 is arranged in a purge passage 19 which communicates between the purge port 17 and the fuel tank 15. Between the canister 21 and the purge port 17, a purge control valve 23 is provided which is energized by a control signal having a variable duty ratio, as will be referred to hereinafter in detail. The canister 21 is filled with an absorbing substance 21*a* such as activated carbon which captures fuel vapor before it can escape to the atmosphere. Fresh air or atmospheric air is normally introduced into the canister 21 from an air inlet port 25 through a purge air induction passage 17. The purge control valve 23 is adapted to selectively establish and block communication between the canister 21 and the purge port 17 for regulating a rate of fuel vapor purged from the canister. When the purge control valve 23 is energized to be opened and the engine 1 is operating, the difference in pressure between the canister 21 (i.e., the atmospheric pressure) and the intake passage 3 (i.e., negative pressure) purges the fuel vapor collected in the activated carbon 21*a* in a manner wherein it is drawn into an induction passage of the engine 1.

In an exhaust passage 3 of the engine 1, a catalytic converter 33 is arranged. A secondary air inlet port 35 is formed in a portion of the exhaust passage 3 immediately upstream from the catalytic converter 33. An air pump 41 is arranged to communicate with the secondary air inlet port 35 through a secondary air passage 18 so that compressed or pressurized air is supplied to the air inlet port 35. A three-way valve 43 is adapted to selectively establish communications between the air inlet port 25 and the canister 21 and between the secondary air inlet port 35 and the air pump 41 as will be described hereinafter in detail.

Figure 2A:
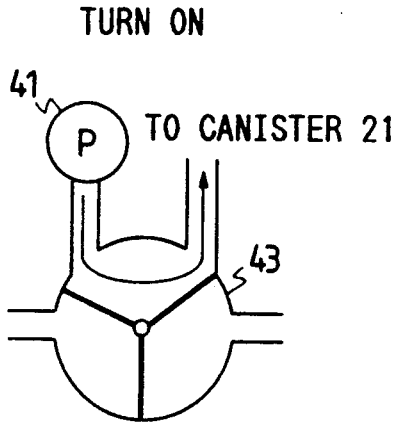
Figure 2B:
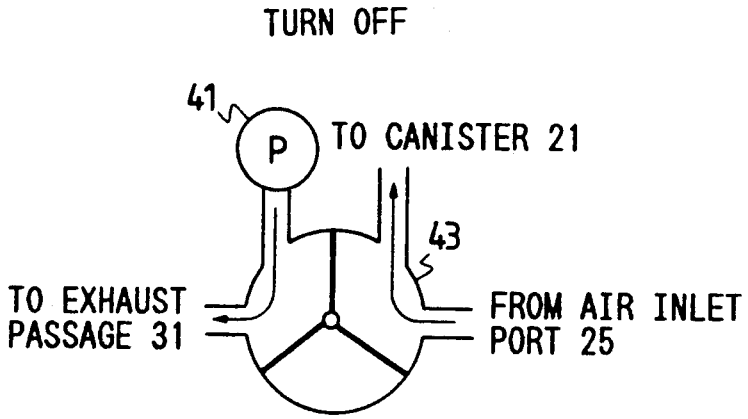

When the three-way valve 43 is energized, it, as shown in FIG. 2(*a*), establishes the communication between the canister 21 and the air pump 41 with both the communication between the canister and the air inlet port 25 and between the exhaust passage 31 and the air pump 41 being blocked. Alternatively, when the three-way valve 43 is deenergized, it, as shown in FIG. 2(*b*), establishes the communication between the canister 21 and the air inlet port 25 and between the exhaust passage 31 and the air pump 41 with the communication between the canister 21 and the air pump 41 being blocked. It will be appreciated that the three-way valve 43 is electrically controlled to selectively establish the communication of the air pump 41 either with the canister 21 or the exhaust passage 31.

Figure 3:
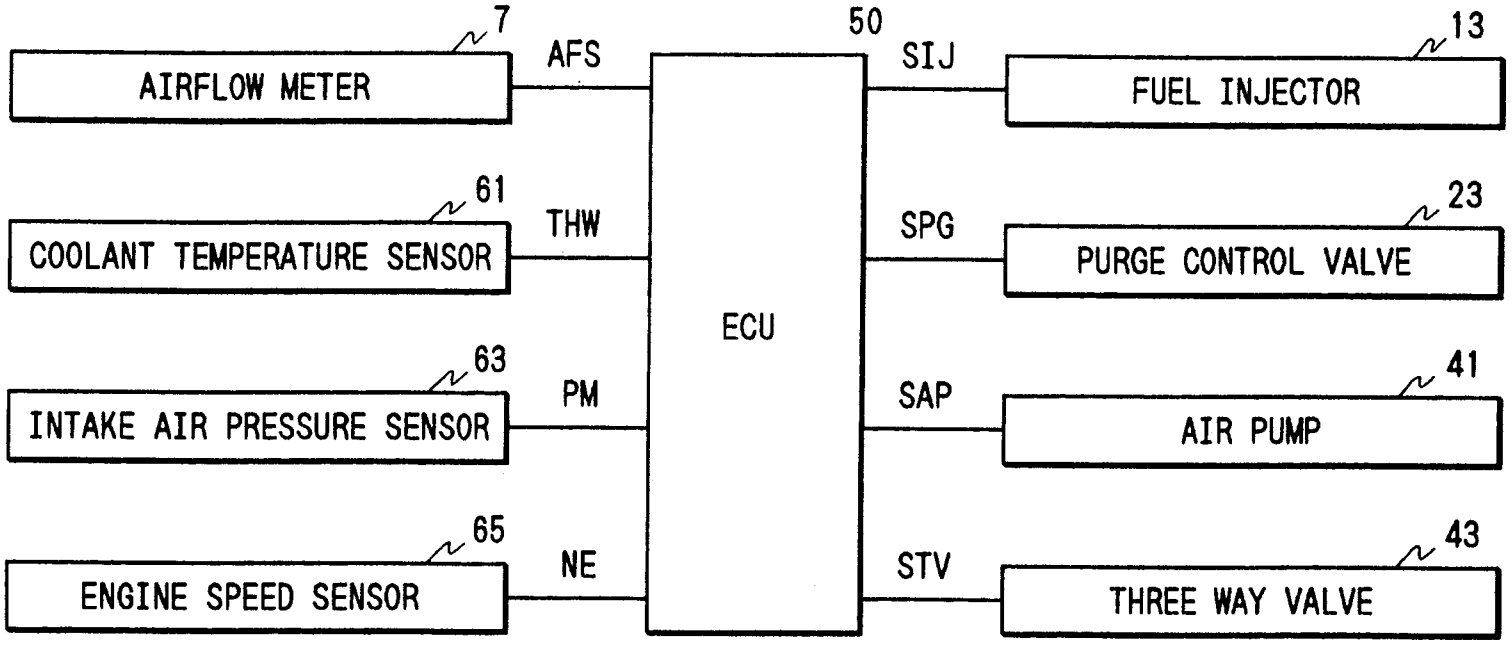
FIG. 3 is a block diagram which shows a control circuit of a fuel vapor purging control system.

Referring to FIG. 3, the fuel vapor purging control system includes an engine control unit (ECU) 50 to which sensor signals AFS, THW, PM, and NE from the airflow meter 7, a coolant temperature sensor 61, an intake air pressure sensor 63, and an engine speed sensor 65 are input respectively. The airflow meter 7 is, as shown in FIG. 1, disposed in the intake passage 3 downstream from the air cleaner 5 to monitor a flow rate AFS of air drawn into the engine 1. The coolant temperature sensor 61 is attached to a cylinder wall 1*a* of the engine 1 to detect temperature THW of coolant circulating in the engine. The intake air pressure sensor 63 is arranged in a portion of the exhaust passage 3 downstream from the throttle valve 9 to monitor a pressure level PM of air introduced into the engine 1. The engine speed sensor 65 monitors the number of revolutions of a crank shaft (not shown) of the engine 1 to project engine speed NE. The ECU 50 is responsive to the sensor signals AFS, THW, PM, and NE to provide control signals SIJ, SPG, SAP, and STV to the fuel injector 13, the purge control valve 23, the air pump 41, and the three-way valve 43 respectively.

The system of this embodiment is adapted to perform the so-called mass-flow control for fuel injection wherein engine load is calculated based on the parameters AFS and NE detected from the airflow meter 7 and the engine speed sensor 65. Therefore, in this embodiment, the intake air pressure sensor 63 is not used for speed density control, but for canister purge control, as will be described hereinafter in detail. The intake air pressure sensor 63 is, thus, arranged between the surge tank 11 and the throttle valve 9.

Figure 4:
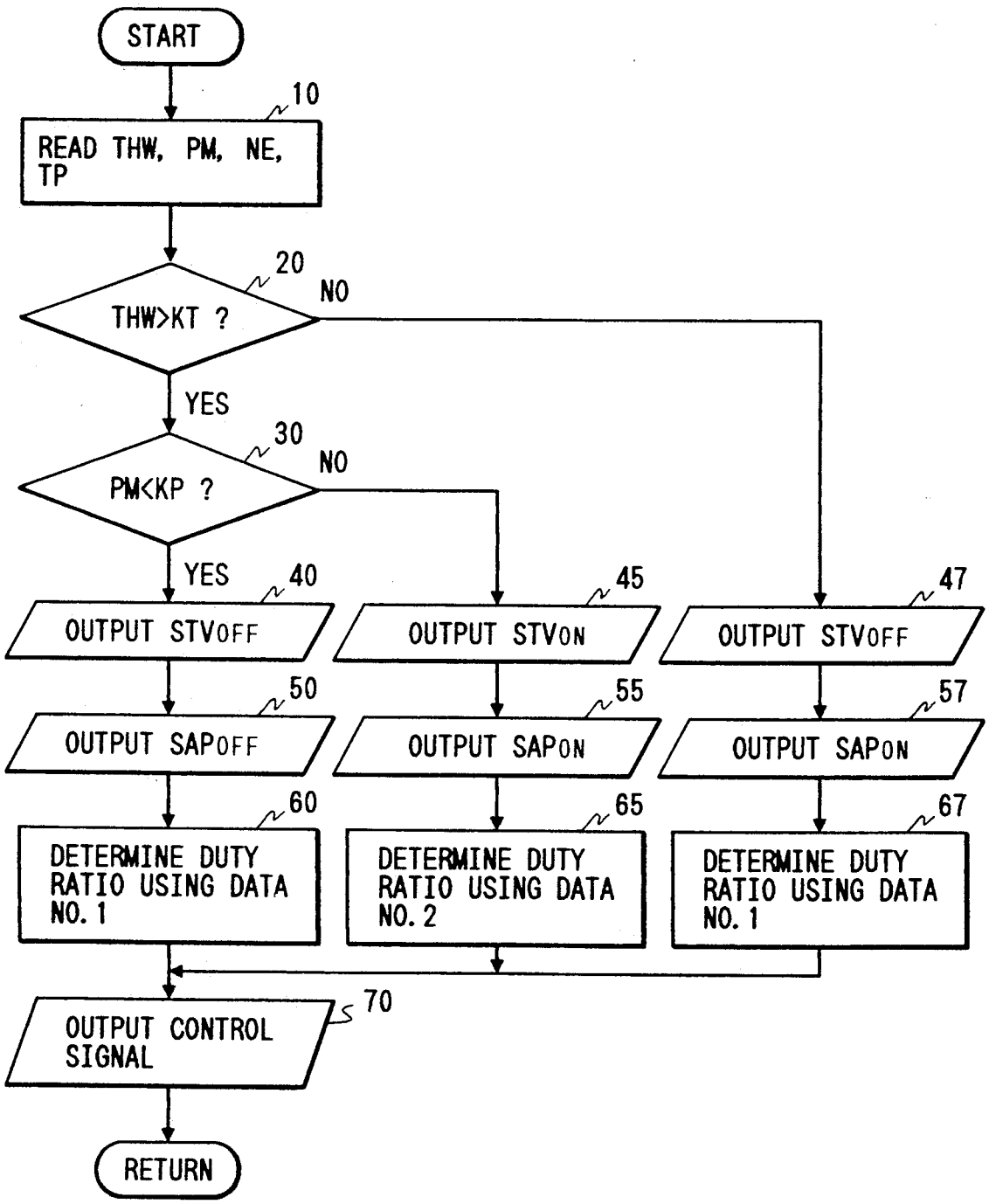
FIG. 4 is a flowchart which shows logical steps for controlling a purge flow rate through a canister, which is carried out by a control unit of a fuel vapor purging control system.

Referring to FIG. 4, there is shown a flowchart of a program or sequence of the logical steps performed by the ECU 50 for controlling canister purging operation. This program is carried out by timer interrupt at a predetermined time interval.

After entering the program, the routine proceeds to step 10 wherein the ECU 50 monitors the coolant temperature THW, the intake air pressure PM, and the engine speed NE detected from the coolant temperature sensor 61, the intake air pressure sensor 63, and the engine speed sensor 65 respectively and a reference pulse TP which is calculated separately according to algorithm as is well known in the art. Afterwards, the routine proceeds to step 20 wherein it is determined whether the coolant temperature THW is greater than a preselected reference temperature KT (i.e., an engine operating temperature) or not. If a YES answer is obtained (THW>KT), the routine then proceeds to step 30 wherein it is determined whether the intake air pressure PM is smaller than a preselected reference pressure KP or not. It is preferable that the reference pressure KP be set to a relative pressure level of −400 mmHg with respect to atmospheric pressure, which is variable according variation in the atmospheric pressure. Additionally, the reference pressure KP may be set to a constant absolute pressure level such as 360 mmHg.

Figure 5:
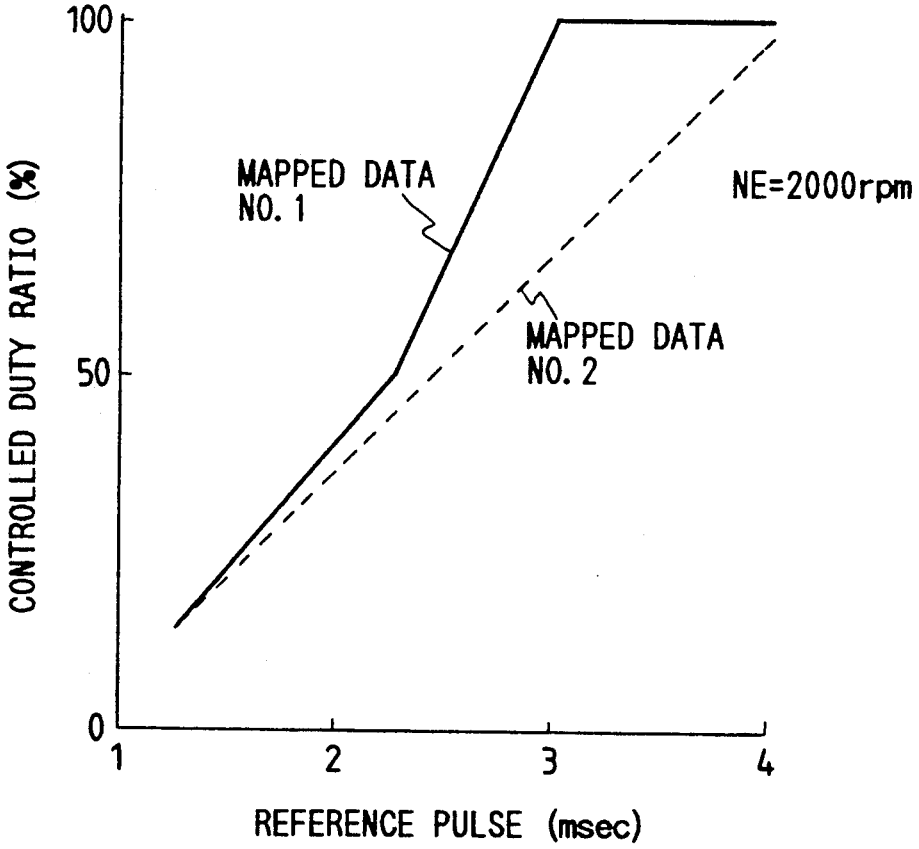
FIG. 5 is a graph which shows mapped data utilized in determination of a duty ratio of a control signal for a purge control valve.

If a YES answer is obtained in step 30 (PM<KP), the routine then proceeds to step 40 wherein the ECU 50 outputs a signal $STV_{OFF}$ to the three-way valve 30 to deenergize it. Also, in step 50, a signal $SAP_{OFF}$ is output to the air pump 41 to deenergize it. Afterward, the routine proceeds to step 60 wherein a duty ratio of a control signal for the purge control valve 23 is determined by look-up using mapped data No. 1, as shown in FIG. 5, based on the engine speed NE and the reference pulse TP. The routine then proceeds step 70 wherein the control signal having the duty ratio determined in step 60 is output to the purge control valve 23 to establish an effective variable restriction in the purge passage 19.

Therefore, when the coolant temperature THW is much higher and the intake air pressure PM is much lower, that is, when warm up operation of the engine has been completed and engine speed or load falls to a lower level, the three-way valve 43 is controlled to establish the communication between the canister 21 and the air inlet port 25 so that intake passage vacuum (i.e., engine manifold vacuum) draws outside air, as shown by the arrow A in FIG. 1, into the canister 21. It will be appreciated that the pressure difference between the intake air pressure PM and the atmospheric pressure serves to purge the fuel vapor collected in the canister 21.

If a NO answer is obtained in step 30 concluding that the intake air pressure PM is greater than or equal to the reference pressure PK, that is, that the engine speed is relatively high, the routine then proceeds to step 45 wherein a signal $SAP_{ON}$ is output to the three-way valve 43. Also, in step 55, a signal $SAP_{ON}$ is output to the air pump 41 to energize it. The routine then proceeds to step 65 wherein the duty ratio of the control signal is determined by look-up using mapped data No. 2, as shown in FIG. 5, based on the engine speed NE and the reference pulse TP. The routine then proceeds step 70 wherein a control signal having the duty ratio determined in step 65 is output to the purge control valve 23.

Therefore, when the coolant temperature THW is relatively high with the intake air pressure PM not being low, that is, when the warm up operation of the engine 1 is completed and the engine is operating at high loads, the three-way valve 43 is controlled to establish the communication between the canister 21 and the air pump 41 to supply compressed air, as shown by the arrow B in FIG. 1, into the canister 21. The pressure difference between the intake air pressure PM and the pressurized air from the air pump 41 thus causes the fuel vapor to be purged from the canister 21.

Referring to FIG. 5, a table representing the mapped data Nos. 1 and 2 is shown. The table indicates one example of the relation between a duty ratio of a control signal output to the purge control valve 23 and the reference pulse TP when the engine speed NE is 2000 rpm. The mapped data No. 1 provides greater duty ratios than the mapped data No. 2. Accordingly, when the three-way valve 43 assumes a valve position where the pressurized air is supplied to the canister 21, the purge control valve 23 opens to a degree greater than that when drawing the outside air through the air inlet port 25. The introduction of the pressurized air into the canister 21 induces a great pressure difference between the upstream and downstream lines of the canister even though an opening degree of the purge control valve 23 is relatively small, assuring a high purge flow rate as compared with the introduction of the outside air.

If a NO answer is obtained in step 20 concluding that the coolant temperature THW is less than or equal to the reference temperature KT and thus the warm up operation is not yet completed, the routine then proceeds to step 47 wherein the signal $SAP_{OFF}$ is output to the three-way valve 43 to communicate between the canister 21 and the air inlet port 25 so that the outside air is drawn into the canister 21. The routine then proceeds to step 57 wherein the signal $SAP_{ON}$ is output to the air pump 41 to energize it. The routine then proceeds to step 67 wherein the duty ratio of the control signal is, likewise to step 60, determined by look-up using mapped data No. 1, as shown in FIG. 5, based on the engine speed NE and the reference pulse TP. The routine then proceeds step 70 wherein the control signal having the duty ratio determined in step 67 is output to the purge control valve 23 to provide a relatively small effective restriction in the purge passage 19.

Therefore, when the engine 1 is cold during warm up modes, the three-way valve 43 is controlled to establish the communication between the air pump 41 and the exhaust passage 31 while blocking the communication between the air pump and the canister 21. When the air pump 41 is turned on, it provides secondary air to the exhaust passage 31 through the secondary air inlet port 35, which, in turn, promotes oxidation in an exhaust system, elevating the temperature of exhaust gas. The elevated temperature of the exhaust gas then causes the catalytic converter 33 to be activated. The secondary air also serves to burn unburned combustibles contained in the exhaust gas. Accordingly, even when the engine is cold and thus a degree of activation in the catalytic converter 33 is relatively low, the catalytic converter 33 may be activated quickly, thus reducing the unburned combustibles to enhance purging efficiency of the exhaust gas.

In general, during warm up operation, the engine falls to a lower load level which causes a difference in pressure between the atmosphere and the intake passage 3 required for drawing outside air into the canister 21 for purging the fuel vapor collected therein to be generated. Accordingly, in the system of this embodiment, before the warm up operation has been completed, the duty ratio of the purge control valve 23 is controlled according to the mapped data No. 1 to provide a relatively small flow restriction in the purge passage 19. The subatmospheric pressure (i.e., negative pressure) in the intake passage 3 (i.e., the intake manifold) of the engine 1 draws the outside air into the canister 21 through the air inlet port 25 and purges the fuel vapors collected in the canister.

Additionally, during warm up operation, when the engine 1 falls to a higher load level which causes the subatmospheric pressure in the intake passage 3 to be relatively high, the pressure difference between the atmosphere and the intake passage 3 is reduced below a level required for purging the fuel vapors collected in the canister 21. However, there is a small pressure difference existing between the atmosphere and the intake passage 3 which serves to prevent the fuel vapor in the canister 21 from escaping to the atmosphere when the purge control valve 23 is energized to be opened. Accordingly, under these conditions, the system of this embodiment performs the conventional purge control according to steps 47 to 67 for improving exhaust gas purging ability with pressurized air supplied from the air pump 41 to the exhaust passage 31.

Figure 6:
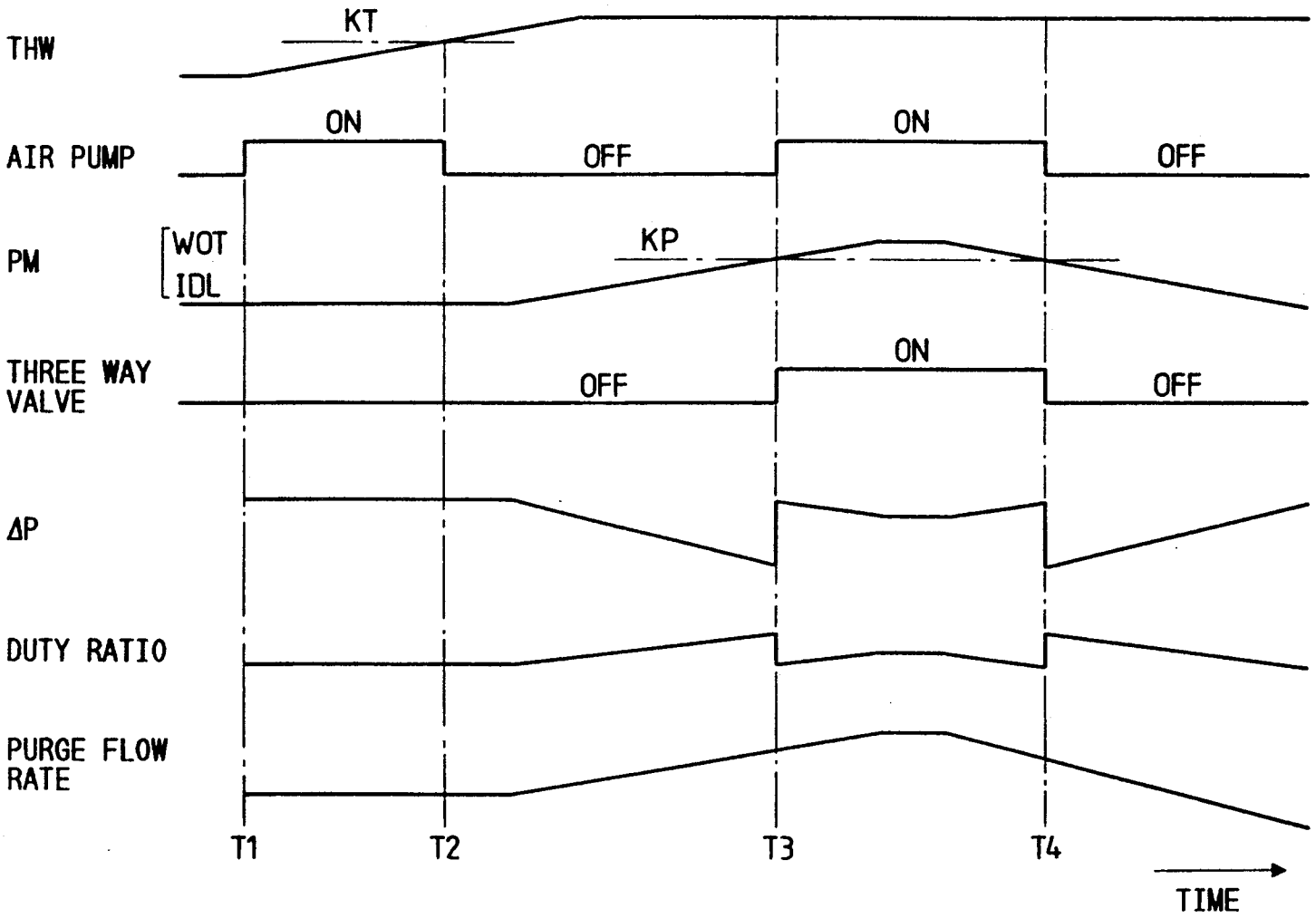
FIG. 6 is a time-chart which shows the operation of a fuel vapor purging control system of the invention.

Referring to FIG. 6, there is shown a timechart which represents operation timing relationships among the coolant temperature THW, the air pump 41, the intake air pressure PM, the three-way valve 43, the pressure difference ΔP between upstream and downstream lines from the canister 21, the duty ratio of the control signals output to the purge control valve 23, and the purge flow rate through the canister 21.

When the coolant temperature THW just after start-up of the engine 1 is low, the air pump 41 and the three-way valve 43 are energized for a period of time from $T_1$ to $T_2$. The intake air pressure PM represents a lower level IDL. When the coolant temperature THW exceeds the reference temperature KT at $T_2$, both the air pump 41 and the three-way valve 43 are deenergized until an opening degree of the throttle valve 9 becomes great to elevate the intake air pressure PM to the reference pressure KP. When the engine warm up operation has been completed and the intake air pressure PM reaches the reference pressure KP at $T_3$, the air pump 41 and the three-way valve 43 are energized again. Afterwards, the intake air pressure PM becomes lower than the reference pressure KP at $T_4$, the air pump 41 and the three-way valve 43 are deenergized again.

The pressure difference ΔP between the upstream and downstream lines of the canister 21 (i.e., the difference between the intake air pressure PM and atmospheric pressure) is decreased according to increase in the intake air pressure PM, but however, increased quickly at $T_3$ due to the pressurized air supplied from the air pump 41 to the canister 21. Thereafter, the pressure difference ΔP is reduced gradually until the intake air pressure PM reaches a pressure level WOT at which the throttle valve 9 is fully opened.

The duty ratio of a control signal for the purge control valve 23 is determined based on the mapped data No. 1 until $T_3$. When the pressurized air is supplied to the canister 21 at $T_3$, the duty ratio is modified quickly to a lower value which is determined based on the mapped data No. 2. The purge flow rate through the canister 21 is, however, controlled to be increased according to an opening degree of the throttle valve 9. This is due to the fact that the pressurized air supplied to the canister 21 secures a required degree of the pressure difference ΔP to cause the purge flow rate to rise even when the duty ratio is set to the lower value.

Figure 7:
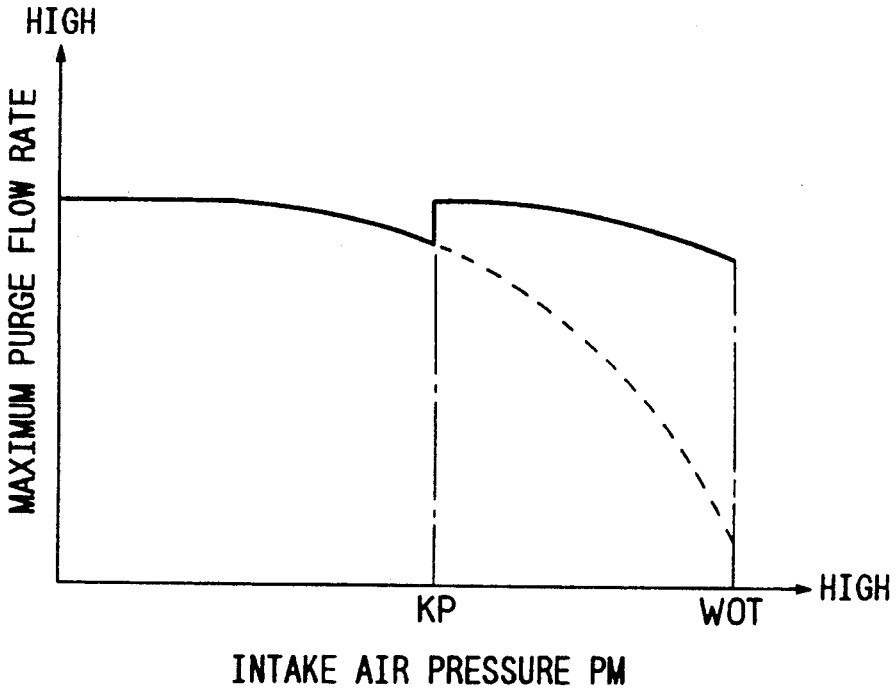
FIG. 7 is a graph which shows a relation between intake air pressure and a maximum purge flow rate.

Referring to FIG. 7, a relation between a maximum purge flow rate and the intake air pressure PM is shown. The maximum purge flow rate represents an amount of fuel gas which may be purged when the duty ratio is 100%.

In the graph, the broken line shows a purge flow rate under the conventional purging control. It will be noted that when the throttle valve 9 is fully opened and the intake air pressure PM rises to the higher level WOT, the purge flow rate is substantially reduced to zero. The solid line, after the intake air pressure PM reaches the reference pressure KP, represents a purge flow rate assured by the system of the present invention which is established by the pressurized air supplied from the air pump 43 to the canister 21. It will be appreciated that even when the throttle valve 9 is fully opened and the intake air pressure PM is increased to the higher level WOT, the fuel vapor in the canister 21 may be purged sufficiently.

As clearly from the above, the fuel vapor purging control system of the invention is able to secure a flow rate sufficient for purging fuel vapor even during high load engine operation where the intake passage vacuum is relatively low. Additionally, the purge flow rate may be modified closely by the duty ratio modulation of a control signal to the purge control valve 23 over a wide range of engine operating conditions. Further, when a pressure difference between the intake air pressure PM and atmospheric pressure is higher than a preselected value, the fuel vapor purging control does not require supply of the pressurized air to the canister 21 for the fuel vapor purging control. Thus, the air pump 41 may be operated only in the specific range, resulting in engine load not being increased undesirably.

The air pump 41 also serves to provide secondary air for activating the catalytic converter 33 in the exhaust passage 31 during the high load modes of engine operation. Therefore, there is no need for providing an additional air pump exclusively used for the fuel vapor purging control. Further, the operating range of the air pump 41 for the exhaust gas purging control is different from that for the fuel vapor purging control through the canister 21, thus assuring the exhaust gas purging required.

In addition, even when a driver brings a vehicle under high load engine operating conditions upon start-up of the engine, the exhaust gas purging control program according to steps 20 to 67, as shown in FIG. 4, is executed to give priority to the exhaust gas purging control during engine warm up modes for securing the exhaust gas purging sufficiently.

Figure 8:
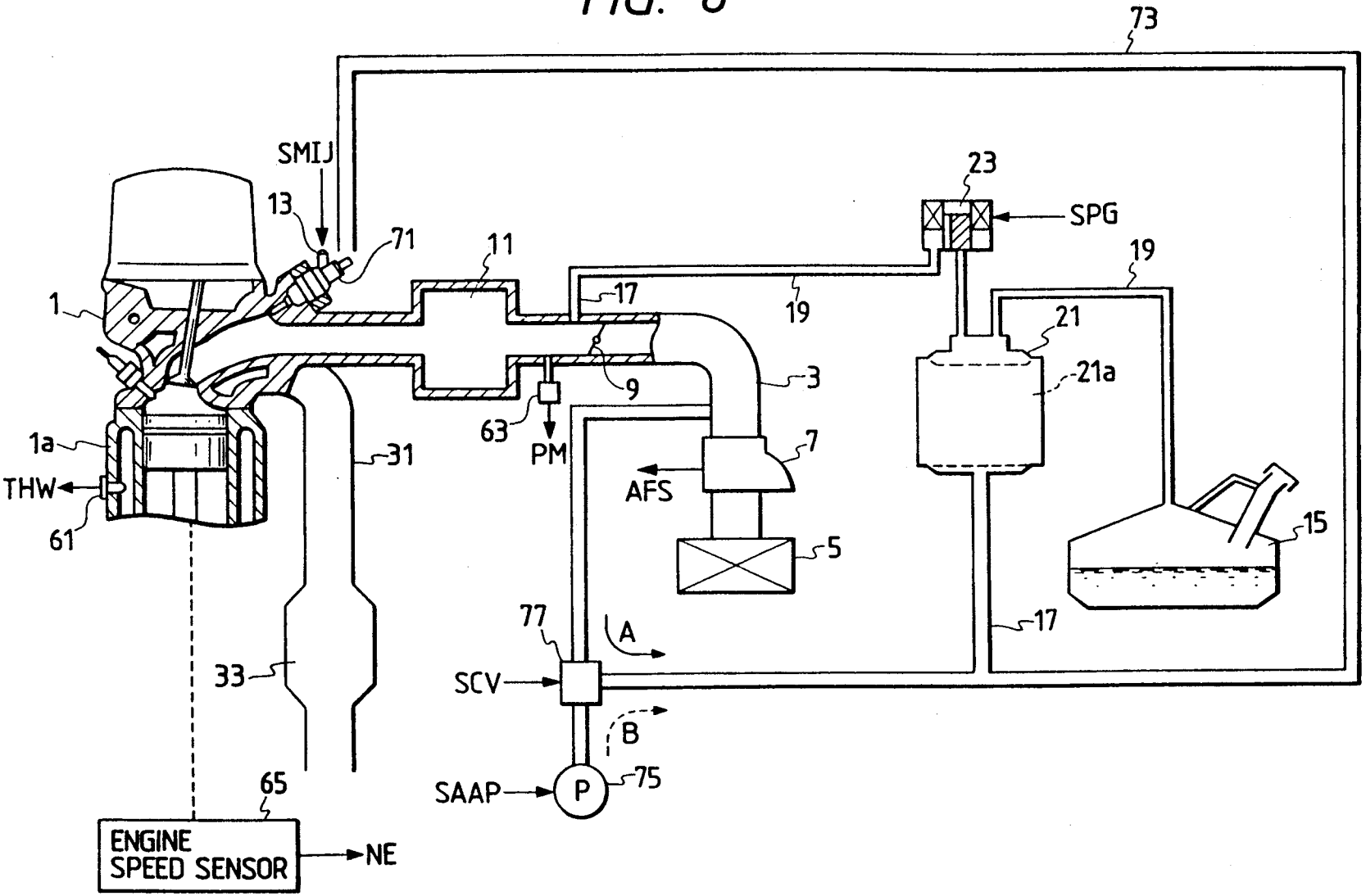
FIG. 8 is an illustration which shows a second embodiment of a fuel vapor purging control system of the invention.

Referring to FIG. 8, an alternative embodiment according to the invention is shown. This embodiment is different from the above described first embodiment in that an assistant air system is provided in place of the secondary air supply system for the exhaust gas purging control.

The fuel vapor purging system of the second embodiment includes an air mixing injector 71, an assistant air passage 73, an assistant air pump 75, and a directional control valve 77. The assistant air passage 73 communicates between an air inlet port of the air mixing injector 71 and a portion of the intake passage 3 just downstream from the airflow meter 7 for introducing air drawn through the air cleaner 5 into the air mixing injector to modify an air/fuel ratio. The assistant air pump 75 serves to provide compressed, or pressurized air during high load modes of engine operation.

The canister 21 communicates with a portion of the assistant air passage 73 downstream from the directional control valve 77 for introducing purging air through the assistant air passage 73. When the directional control valve 77 is deenergized to assume a valve position which allows air flow as shown by a solid arrow A, fresh air drawn through the air cleaner 5 is introduced into the canister 21. Alternatively, when the directional control valve 77 is energized to assume a second valve position which allows air flow as shown by a broken arrow B, the pressurized air is supplied from the assistant air pump 75 to the canister 21.

Figure 9:
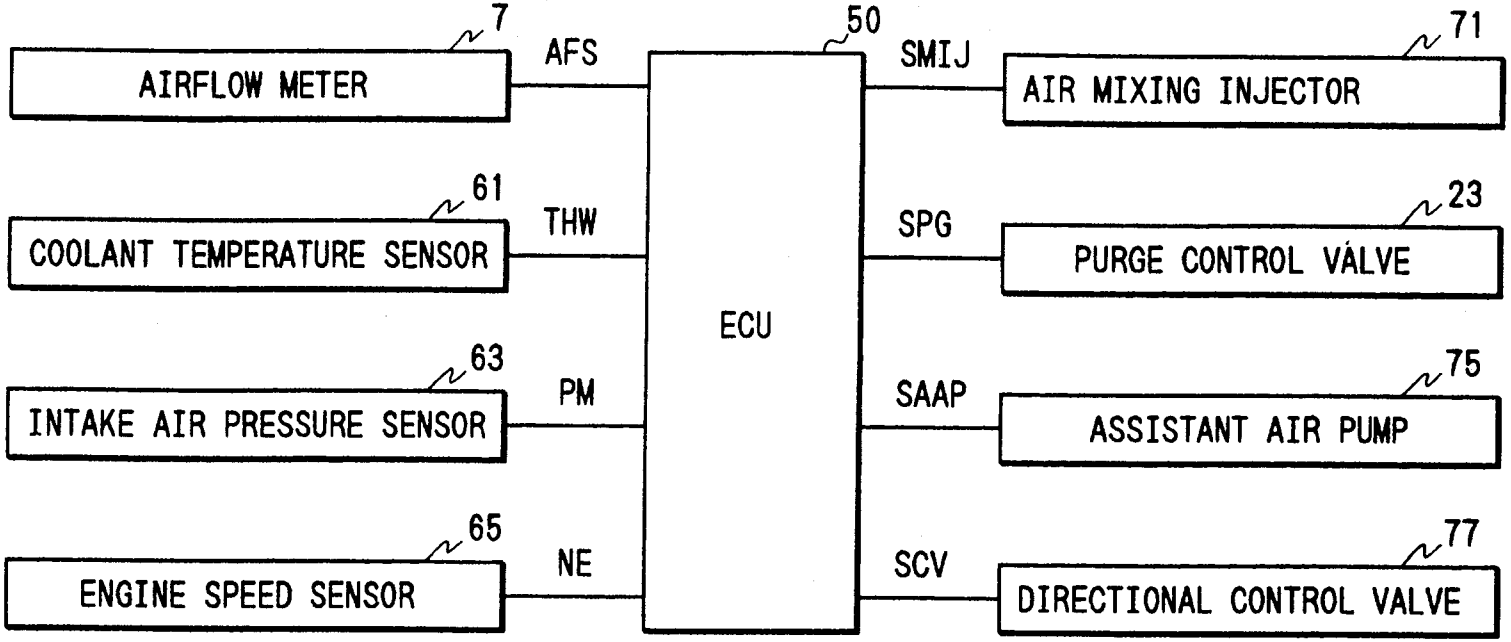
FIG. 9 is a block diagram which shows a control circuit of a second embodiment of a fuel vapor purging control system as shown in FIG. 8.

Referring to FIG. 9, the fuel vapor purging control system includes the ECU 50 to which sensor signals AFS, THW, PM, and NE from the airflow meter 7, the coolant temperature sensor 61, the intake air pressure sensor 63, and the engine speed sensor 65 are input respectively. The ECU 50 is responsive to the sensor signals AFS, THW, PM, and NE to provide control signals SMIJ, SPG, SAAP, and SCV to the air mixing injector 71, the purge control valve 23, the assistant air pump 75, and the directional control valve 77 respectively. The fuel injection is controlled by the mass-flow control system in the same manner as the first embodiment. The intake air pressure sensor 63 is also used for canister purging control.

Figure 10:
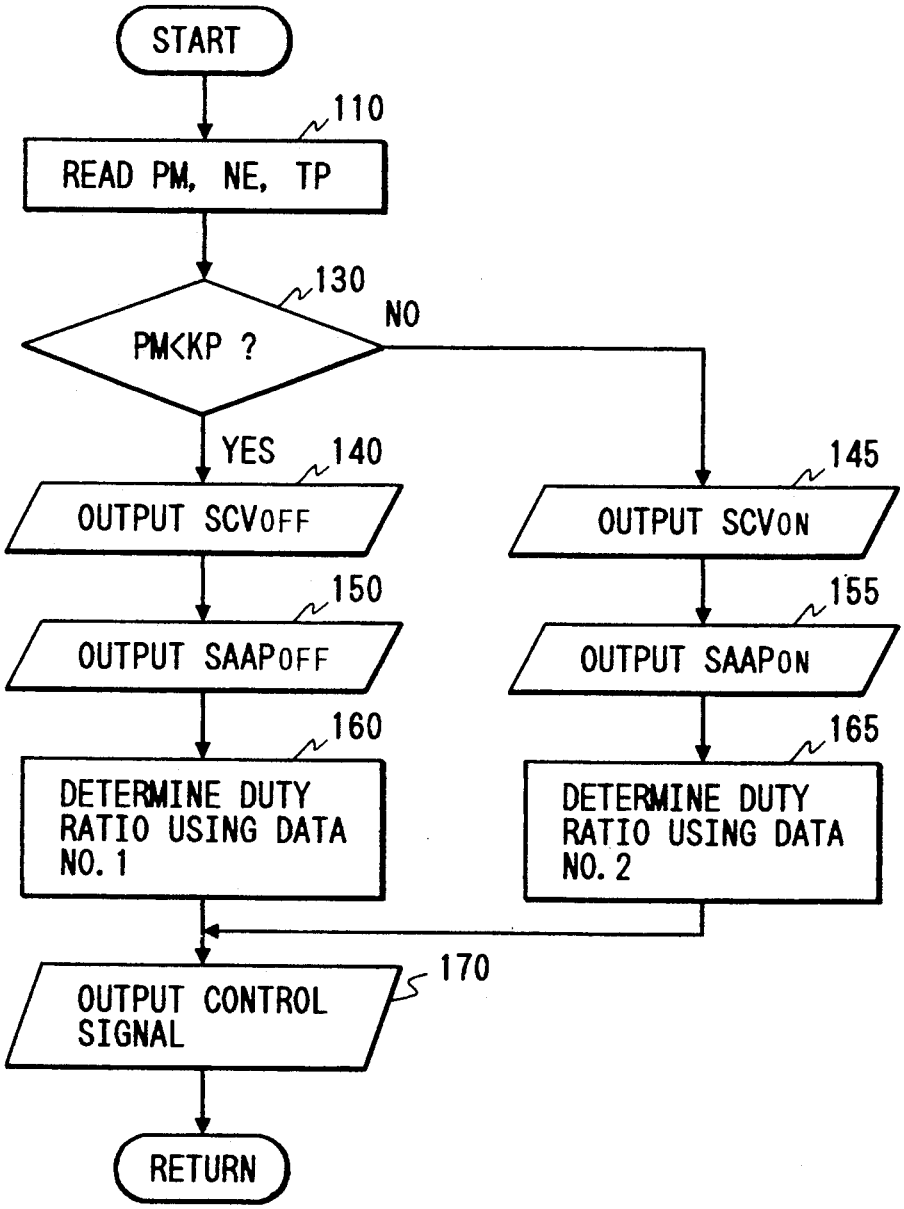
FIG. 10 is a flowchart which shows logical steps performed by a control unit of a second embodiment.

Referring to FIG. 10, there is shown a flowchart of a program or sequence of logical steps performed by the ECU 50 of the second embodiment.

After entering the program, the routine proceeds to step 110 wherein the ECU 50 monitors the intake air pressure PM, the engine speed NE, and the reference pulse TP. The routine then proceeds to step 130 wherein it is determined whether the intake air pressure PM is smaller than a preselected reference pressure KP or not.

If a YES answer is obtained in step 130 ($PM<KP$), the routine then proceeds to step 140 wherein the ECU 50 outputs a signal $SCV_{OFF}$ to the directional control valve 77 to deenergize it. Likewise, in step 150, a signal $SAAP_{OFF}$ is output to the assistant air pump 75 to deenergize it. The routine then proceeds to step 160 wherein a duty ratio of a control signal output to the purge control valve 23 is determined by look-up using the same mapped data No. 1 as the first embodiment based on the engine speed NE and the reference pulse TP. The routine then proceeds step 170 wherein the control signal having the duty ratio determined in step 160 is output to the purge control valve 23.

Alternatively, if a NO answer is obtained in step 130 concluding that the intake air pressure PM is greater than or equal to the reference pressure PK, the routine then proceeds to step 145 wherein a signal $SCP_{ON}$ is output to the directional control valve 77. Also, in step 155, a signal $SAAP_{ON}$ is output to the assistant air pump 75 to energize it. The routine then proceeds to step 165 wherein the duty ratio of the control signal output to the purge control valve 23 is determined by look-up using the same mapped data No. 2, as shown in FIG. 5, based on the engine speed NE and the reference pulse TP. After step 165, the routine proceeds step 170 as mentioned above.

With the above canister purging control, when the engine 1 is operating at high loads and pressure in the intake passage 3 becomes high, the pressurized air is supplied from the assistant air pump 75 to both the canister 21 and the air mixing injector 71. The assistant air supply to the canister 21 and the air mixing injector 71 may be made at the same time because the canister 21 and the air mixing injector 71 both require the pressurized assistant air under substantially the same conditions. Thus, even when the pressure difference between atmospheric pressure and the intake air pressure is relatively low, the pressurized assistant air serves to purge fuel vapor collected in the canister 21 properly.

Figure 11:
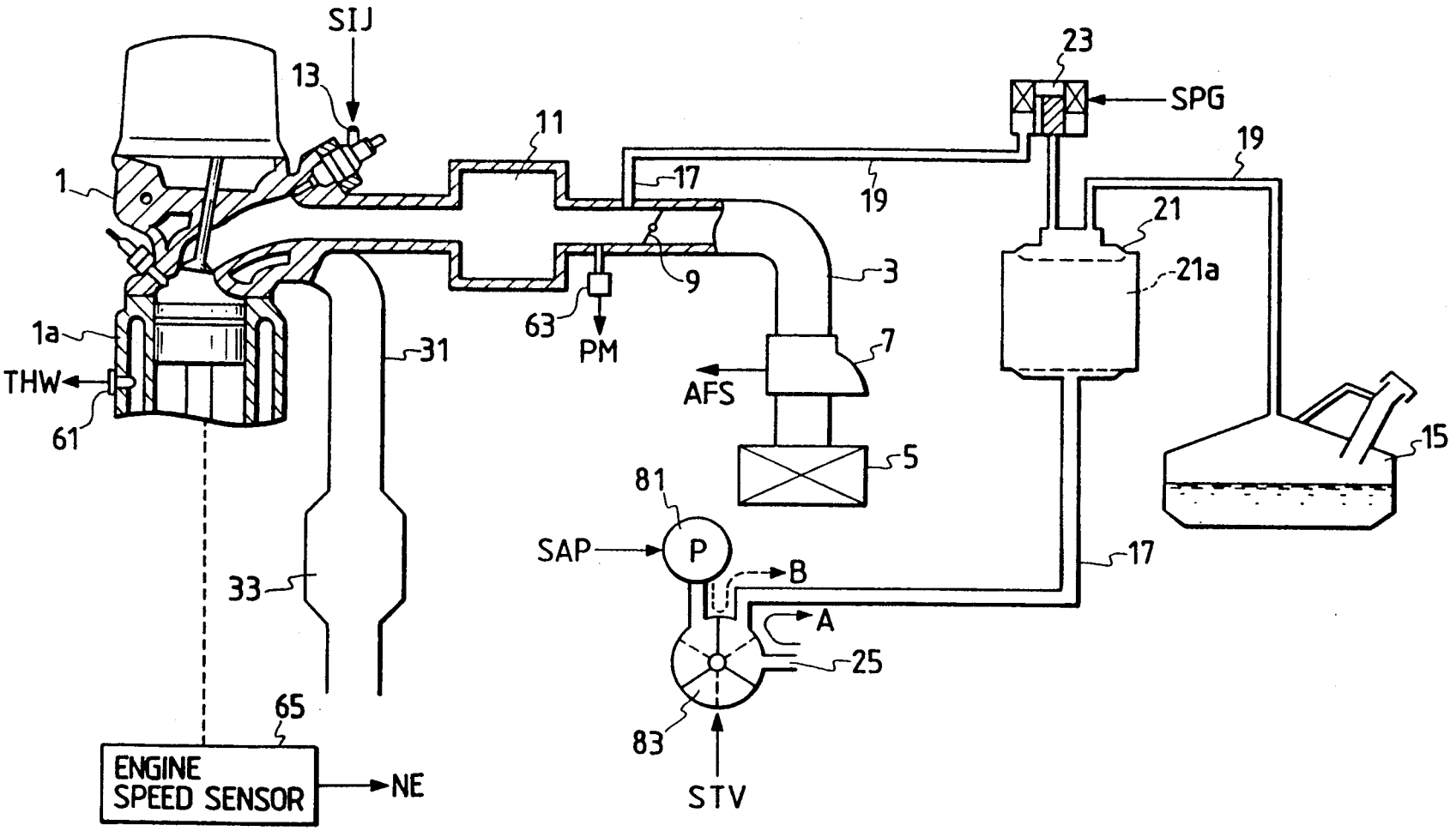
FIG. 11 is an illustration which shows a third embodiment of a fuel vapor purging control system of the invention.

Referring to FIG. 11, a third embodiment of the invention is shown. The system of this embodiment includes a three-way valve 83 and an air pump 81. The three-way valve 83 is arranged to be switched between two valve positions; one is to establish communication between the air inlet port 25 and the canister 21 and the other is to establish communication between the air pump 81 and the canister 21. The purge control valve 23 is controlled based on a duty ratio of a control signal SPG, similarly to the above embodiments. In a mode where the pressurized air is introduced into the canister 21 from the assistant air pump 81, the three-way valve 83 blocks the communication between the canister 21 and the air inlet port 25, thereby preventing fuel vapors in the canister 21 from escaping to the atmosphere.

Additionally, while in the above first and second embodiments, the determination of whether the pressurized air is supplied to the canister 21 or not is made based on the sensor signal detected by the intake air pressure sensor 63, it may be made based on another parameter representing a degree of engine load such as opening of the throttle valve 9, a flow rate of intake air per one engine revolution AFS/NE, or an intake air pressure level under speed density control. Further, the use of the intake air pressure sensor 62 operable to detect an intake air pressure level in a line adjacent the purge port 17 enables direct determination of whether the intake passage vacuum level is sufficient for purging the canister 21 or not.

Figure 12:
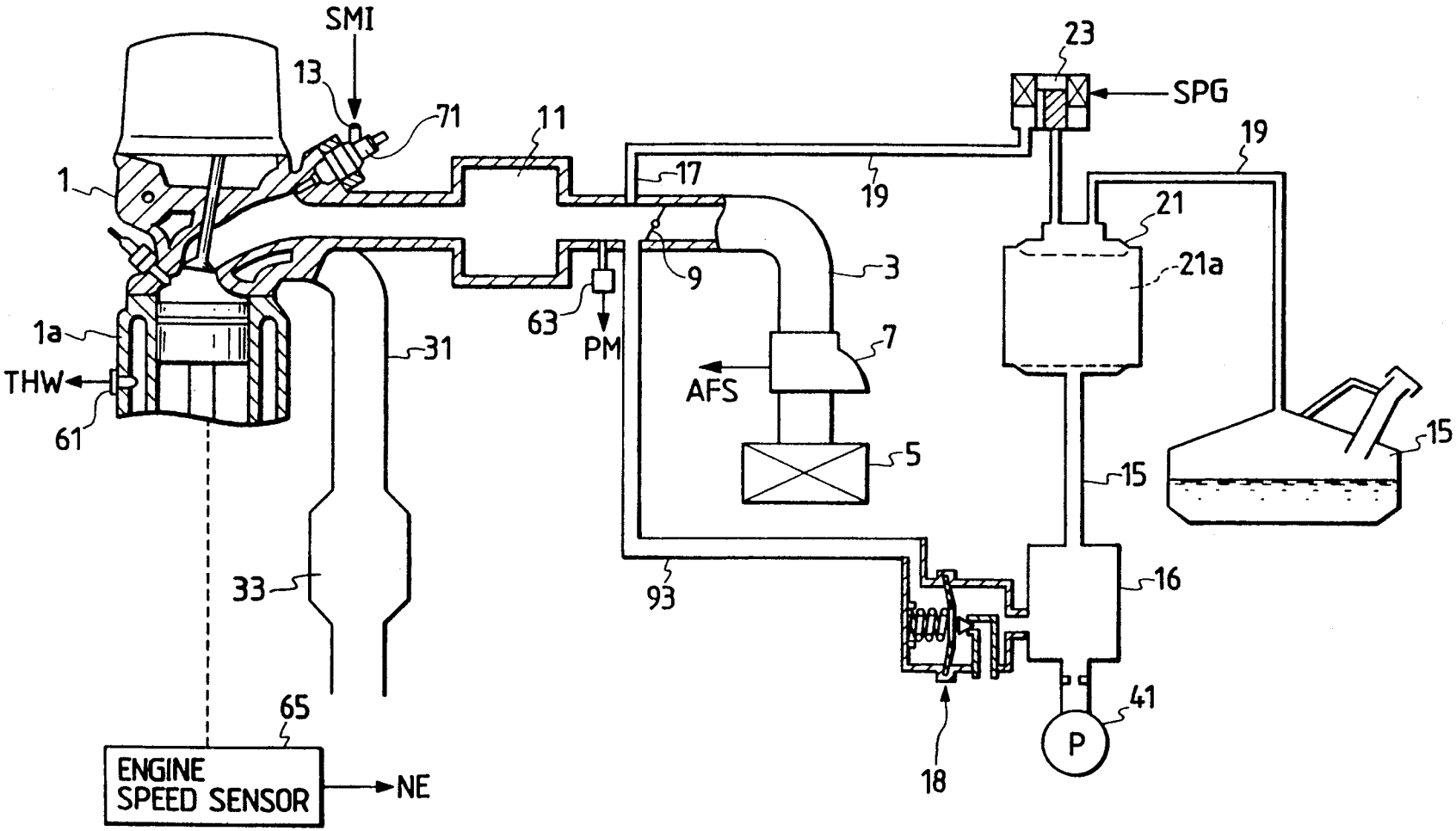
FIG. 12 is an illustration which shows a fourth embodiment of a fuel vapor purging control system of the invention.

Referring to FIG. 12, there is shown a fourth embodiment of the fuel vapor purging control system.

The system of this embodiment includes a pressure regulating chamber 16 and a pressure regulator 18. The pressure regulating chamber 16 is connected to the canister 21 through a purge air induction line 15. The air pump 41 is driven by the engine 1 to supply pressurized air to the pressure regulating chamber 16 so that a pressure level therein is maintained above atmospheric pressure. The pressure regulator 18 communicates between the pressure regulating chamber 16 and a portion of the intake passage 3 downstream from the throttle valve 9 through a pressure line 93 to modify the pressure level in the pressure regulating chamber 16 so as to maintain the pressure difference between upstream and downstream lines of the canister 21 at a preselected constant value.

Figure 13:
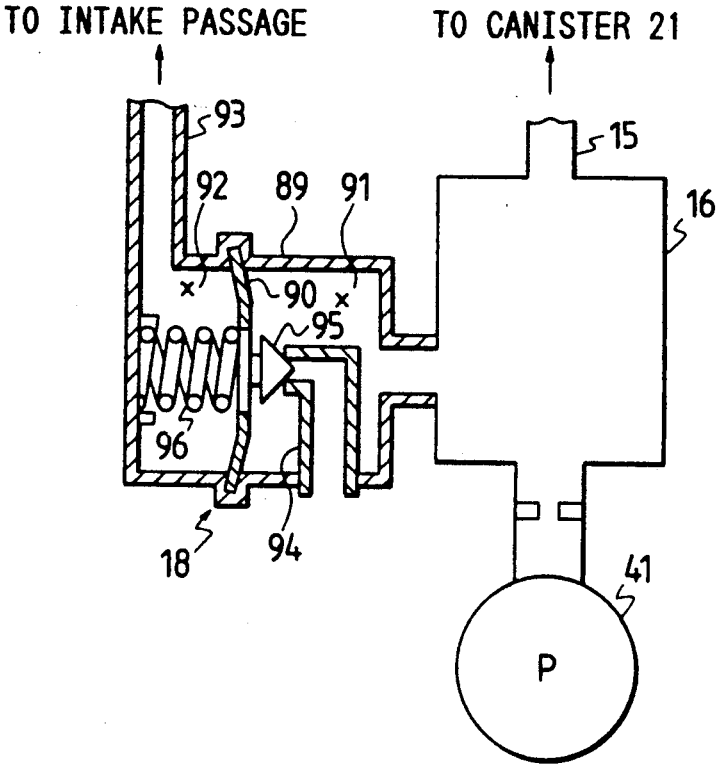
FIG. 13 is a sectional view which shows a pressure regulator and a pressure regulating chamber for controlling a degree of intake air passage vacuum.

Referring to FIG. 13, the pressure regulator 18 includes a casing 89, a diaphragm 90, an air outlet port 94, a poppet valve 95, and a spring 96. The diaphragm 90 defines first and second chambers 91 and 92 in the casing 89. The first chamber 91 communicates with the pressure regulating chamber 16. The second chamber 92, as shown in FIG. 12, communicates with the intake passage 3. The poppet valve 95 is fixed on the central portion of the diaphragm 90 and urged by the spring 96 to block communication between the first chamber 91 and the air outlet port 94 which is exposed to atmospheric pressure.

With the above arrangements, when a difference in pressure between the first and second chambers 91 and 92, or between the pressure regulating chamber 16 and the intake passage 3 exceeds a preselected level as a result of either pressure elevation in the pressure regulating chamber 16 or pressure reduction in the intake passage 3, it will cause the diaphragm 90 to be biased against spring force of the spring 96 so that the poppet valve 95 is urged to discharge the pressure in the second chamber 92 to the atmosphere, thereby causing the pressure difference between the pressure regulating chamber 16 and the intake passage 3 to be maintained constant.

Figure 14:
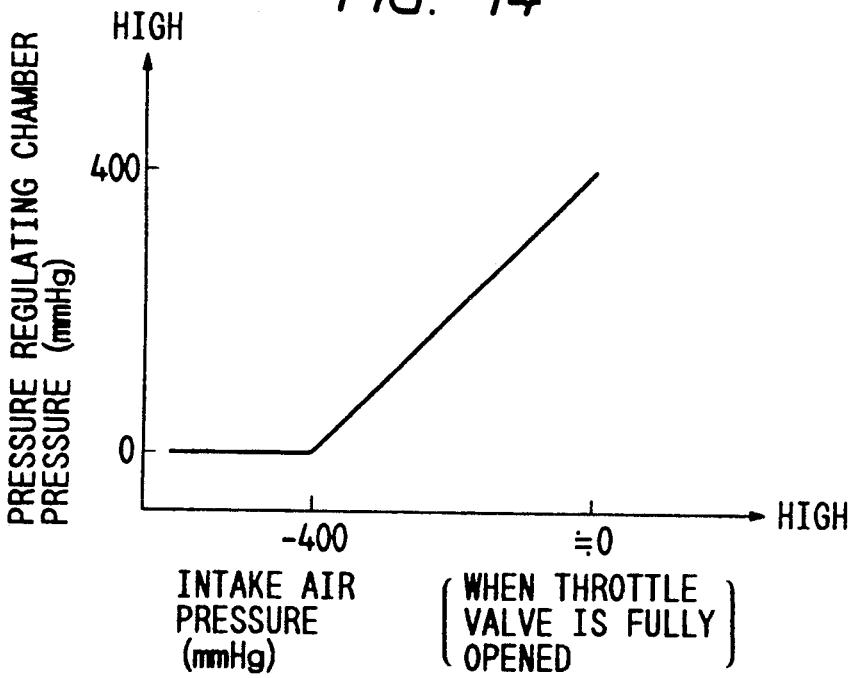
FIG. 14 is a graph which shows a relation between pressures in an intake air passage and a pressure regulating chamber.

FIG. 14 shows a relation between pressures in the pressure regulating chamber 16 and the intake passage 3.

As can be seen in the graph, when the intake air pressure PM in the intake passage 3 (i.e., a pressure level relative to atmospheric pressure) is less than −400 mmHg, the pressure regulator 18 establishes the communication between the first chamber 91 and the air outlet port 94 so that a pressure level in the pressure regulating chamber 16 is regulated to the atmospheric pressure. When the engine 1 falls in a high load operation range and the intake air pressure PM becomes greater than −400 mmHg, it will cause the diaphragm 90 to be urged to have the poppet valve 95 block the communication between the first chamber 91 and the air outlet port 94. Thus, the pressure level in the pressure regulating chamber 16 is elevated in proportion to the increase in the intake air pressure PM to maintain the pressure difference therebetween at the critical pressure of 400 mmHg.

Figure 16:
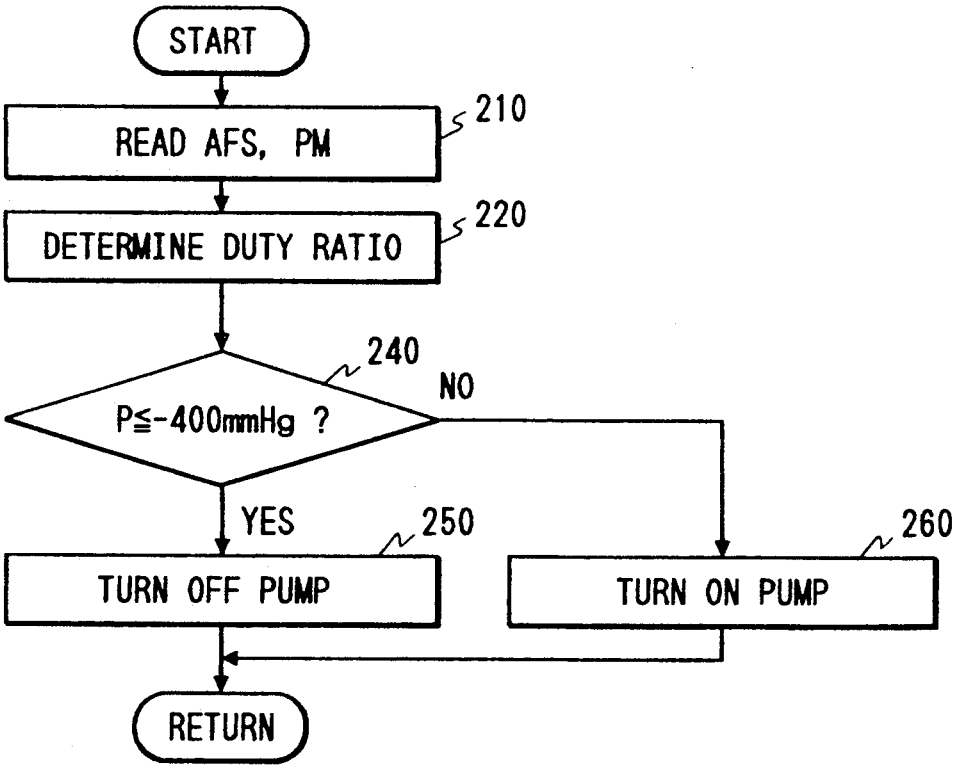
FIG. 16 is a flowchart which shows logical steps performed by a control unit of a fourth embodiment of a fuel vapor purging control system.

Referring to FIG. 16, there is shown a flowchart which represents the canister purging operation of the fourth embodiment.

Figure 15:
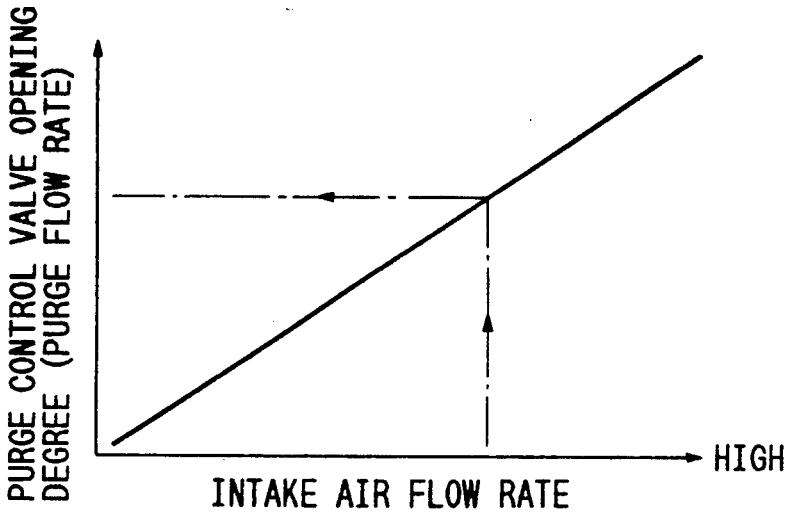
FIG. 15 is a graph which shows a relation between an opening degree of a purge control valve and an intake air flow rate.

After entering the program, the routine proceeds to step 210 wherein the ECU 50 monitors the flow rate of intake air AFS and the intake air pressure PM. The routine then proceeds to step 220 wherein a duty ratio of a control signal provided to the purge control valve 23 is determined using preselected mapped data as shown in FIG. 15. The purge control valve 23 is duty ratio modulated to establish an effective variable restriction in the purge passage 19 to provide a purge flow rate according to the intake air flow rate AFS. The duty ratio may alternatively be determined based on engine speed and an opening degree of the throttle valve 9 as well as the intake air flow rate.

Afterwards, the routine proceeds to step 240 wherein it is determined whether the intake air pressure PM is less than or equal to −400 mmHg or not. If a YES answer is obtained (PM≦−400 mmHg), the routine then proceeds to step 250 wherein the air pump 41 is turned off so that fresh air under atmospheric pressure is drawn into the pressure regulating chamber 16 through the pressure regulator 18. Alternatively, if a NO answer is obtained in step 240 (PM>−400 mmHg), the routine then proceeds to step 260 wherein the air pump 41 is turned on to provide pressurized air to the pressure regulating chamber 16, maintaining the pressure difference between the pressure regulating chamber 16 and the intake air pressure PM greater than or equal to 400 mmHg.

Accordingly, this embodiment is able to assure a purge flow rate variable in proportion to an opening degree of the purge control valve 23 under different engine operating conditions so that the purge flow rate is controlled closely according to the intake air flow rate AFS.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

For example, the three-way valves 43 and 83 and the directional control valve 77 may be provided with a duty ratio-controlled valve similar to the purge control valve 23. Additionally, while in the fourth embodiment, when the intake air pressure PM is less than or equal to −400 mmHg, the air pump 41 is turned off, it may always be driven by the engine 1.

What is claimed is:

1. A fuel vapor purging control system for an automotive vehicle comprising:

a canister adapted for capturing therein fuel vapor generated from a fuel tank, said canister being arranged in a purge passage communicating between the fuel tank and an induction system of an engine;

a purge control valve operable to control a purge rate of the fuel vapor purged from said canister, said purge control valve being arranged in a portion of the purge passage between said canister and the induction system of the engine;

a purge air induction passage communicating between said canister and an air inlet port which is exposed to atmospheric pressure;

air source means for supplying pressurized air to said canister through said purge air induction passage;

pressure detecting means for detecting negative pressure relative to the atmospheric pressure in the induction system of the engine to provide a signal indicative thereof; and purge air control means for selectively establishing first and second purge air supply modes, the first purge air supply mode being to allow air under the atmospheric pressure to be introduced into said canister through the air inlet port, the second purge air supply mode being to supply the pressurized air from said air source means to said canister, said purge air control means being responsive to the signal from said pressure detecting means to establish the second purge air supply mode when the negative pressure is smaller than a preselected threshold value.

2. A fuel vapor purging control system as set forth in claim 1, wherein said purge air control means includes a directional control valve and a control unit, said directional control valve being operable to selectively assume first and second valve positions, the first valve position being to establish fluid communication between the air inlet port and said canister, the second valve position being to establish fluid communication between said air source means and said canister, said control unit being responsive to the signal from said pressure detecting means to provide a first control signal to said directional control valve to assume the first valve position for establishing the first purge air supply mode when the negative pressure is smaller than the preselected threshold value and a second control signal to said directional control valve to assume the second valve position for establishing the second purge air supply mode when the negative pressure is greater than the preselected threshold value.

3. A fuel vapor purging control system as set forth in claim 1, further comprising a secondary air inlet passage which communicates between said air source means and a portion of an exhaust passage of the engine, said purge control means including a directional control valve and a control unit, said directional control valve being operable to selectively assume first and second valve positions, the first valve position being to establish fluid communications between the air inlet port and said canister and between said air pressure source and said secondary air inlet passage, the second valve position being to establish fluid communication between said air source means and said canister, said control unit being responsive to the signal from said pressure detecting means to provide a first control signal to said directional control valve to assume the first valve position for establishing the first purge air supply mode when the negative pressure is smaller than the preselected threshold value and a second control signal to said directional control valve to assume the second valve position for establishing the second purge air supply mode when the negative pressure level is greater than the preselected threshold value.

4. A fuel vapor purging control system as set forth in claim 3, wherein said control unit further provides a third control signal to said directional control valve to assume the first valve position when an operating temperature of the engine is less than a preselected value.

5. A fuel vapor purging control system as set forth in claim 4, wherein said control unit outputs the first control signal to said directional control valve and controls said purge control valve to provide a variable flow restriction in the purge passage to a first degree when the operating temperature of the engine is greater than the preselected value and the negative pressure is smaller than the preselected threshold value, said control unit outputting the second control signal to said directional control valve and controlling said purge control valve to provide the variable flow restriction in the purge passage to a second degree smaller than the first degree when the operating temperature of the engine is greater than the preselected value and the negative pressure is greater than the preselected threshold value, said control unit outputting the third control signal to said directional control valve and controlling said purge control valve to provide the variable flow restriction to the first degree when the operating temperature of the engine is less than the preselected value.

6. A fuel vapor purging control system as set forth in claim 1, further comprising an assistant air passage communicating between said purge air induction passage and the induction system of the engine, said purge air control means includes a directional control valve and a control unit, said directional control valve being operable to selectively assume first and second valve positions, the first valve position being to establish fluid communication between the induction system and said purge air induction passage, the second valve position being to establish fluid communication between said air source means and the canister, said control unit being responsive to the signal from said pressure detecting means to provide a first control signal to said directional control valve to assume the first valve position for establishing the first purge air supply mode when the negative pressure is smaller than the preselected threshold value and a second control signal to said directional control valve to assume the second valve position for establishing the second purge air supply mode when the negative pressure is greater than the preselected threshold value.

7. A fuel vapor purging control system as set forth in claim 6, wherein said air inlet port is connected to a portion of the induction system upstream from a throttle valve, said assistant air passage communicates between a fuel injector disposed in the induction system downstream from the throttle valve for supplying air to modify an air/fuel ratio and said purge air induction passage, the first valve position being to allow air in the induction system upstream from the throttle valve to be drawn into said canister and the fuel injector, the second valve position being to allow the pressurized air supplied from said air source means to be directed to said canister and the fuel injector.

8. A fuel vapor purging control system for an automotive vehicle comprising:

a canister adapted for collecting therein fuel vapor subsequently generated from a fuel tank, said canister being arranged in a purge passage communicating between the fuel tank and an induction system of an engine:

a purge control valve operable to control a purge rate of the fuel vapor purged from said canister, said purge control valve being arranged in a portion of the purge passage between said canister and the induction system of the engine;

air source means for providing pressurized air to said canister;

pressure regulating means disposed between said air source means and said canister, said pressure regulating means for maintaining a difference in pressure between upstream and downstream lines of said canister at a preselected constant level required for purging the fuel vapor from said canister; and purge control means for controlling said purge control valve to modify a purge rate through said canister according to an operational condition of the engine.

9. A fuel vapor purging control system as set forth in claim 8, wherein said pressure regulating means is exposed to atmospheric pressure when a pressure level in the induction system of the engine is lower than a preselected value.

10. A fuel vapor purging control system as set forth in claim 8, wherein said purge control means deactivates said air source means when a pressure level in the induction system of the engine is lower than a preselected value.

11. A fuel vapor purging control system as set forth in claim 8, wherein said pressure regulating means includes a pressure regulator and a pressure regulating chamber, the pressure regulator including first and second chambers, an air outlet port exposed to the atmospheric pressure, and a valve, the first chamber communicating with a portion of the induction system of the engine, the second chamber communicating with the pressure regulating chamber, the valve being adapted for selectively establishing communication between the second chamber and the air outlet port for maintaining the difference in pressure between the upstream and downstream lines of said canister at the preselected constant level.

12. A fuel vapor purging control system as set forth in claim 8, further comprising an air pressure sensor which monitor a pressure level in the induction system of the engine to provide a signal indicative thereof, said purge control means being responsive to the signal from said air pressure sensor to activate said air source means when the pressure level in the induction system is greater than a preselected value for supplying the pressurized air to said pressure regulating means.

* * * * *